US011322846B2

(12) United States Patent
Oh et al.

(10) Patent No.: US 11,322,846 B2
(45) Date of Patent: May 3, 2022

(54) ANTENNA DEVICE AND DISPLAY DEVICE INCLUDING THE SAME

(71) Applicant: DONGWOO FINE-CHEM CO., LTD., Jeollabuk-do (KR)

(72) Inventors: Yun Seok Oh, Gyeonggi-do (KR); Hee Jun Park, Gyeonggi-do (KR); Seung Hyun Shin, Seoul (KR)

(73) Assignee: DONGWOO FINE-CHEM CO., LTD., Jeollabuk-Do (KR)

( * ) Notice: Subject to any disclaimer, the term of this patent is extended or adjusted under 35 U.S.C. 154(b) by 0 days.

(21) Appl. No.: 17/023,591

(22) Filed: Sep. 17, 2020

(65) Prior Publication Data

US 2021/0083387 A1 Mar. 18, 2021

(30) Foreign Application Priority Data

Sep. 18, 2019 (KR) ..... 10-2019-0114587

(51) Int. Cl.
*H01Q 7/00* (2006.01)
*H01Q 15/16* (2006.01)
*H01Q 1/38* (2006.01)

(52) U.S. Cl.
CPC ..... *H01Q 7/00* (2013.01); *H01Q 1/38* (2013.01); *H01Q 15/168* (2013.01)

(58) Field of Classification Search
CPC ..... H01Q 7/00; H01Q 15/168; H01Q 1/38; H01Q 9/0407; H01Q 5/40; H01Q 1/243; H01Q 1/242; H01Q 1/44; H01Q 1/46; H01Q 1/48
See application file for complete search history.

(56) References Cited

U.S. PATENT DOCUMENTS

2015/0255856 A1* 9/2015 Hong ..... H01Q 9/0407 343/702

FOREIGN PATENT DOCUMENTS

EP 2677597 A1 * 12/2013 ..... H01Q 1/2225

* cited by examiner

*Primary Examiner* — Hoang V Nguyen
(74) *Attorney, Agent, or Firm* — The PL Law Group, PLLC

(57) ABSTRACT

An antenna device according to an embodiment of the present invention includes a dielectric layer, a first radiation pattern disposed on the dielectric layer, a second radiation pattern disposed in the first radiation pattern and partially separated from the first radiation pattern, and a transmission line commonly connected to the first radiation pattern and the second radiation pattern.

14 Claims, 5 Drawing Sheets

ANTENNA DEVICE AND DISPLAY DEVICE INCLUDING THE SAME

CROSS REFERENCE TO RELATED APPLICATIONS AND CLAIM OF PRIORITY

The present application claims the benefit of Korean Patent Application No. 10-2019-0114587 filed on Sep. 18, 2019 at the Korean Intellectual Property Office, the disclosures of which are incorporated by reference herein in their entirety.

BACKGROUND

1. Field

The present invention relates to an antenna device and a display device including the same. More particularly, the present invention relates to an antenna device including an electrode and a dielectric layer and a display device including the same.

2. Description of the Related Art

As information technologies have been developed, a wireless communication technology such as Wi-Fi, Bluetooth, etc., is combined with a display device in, e.g., a smartphone form. In this case, an antenna may be combined with the display device to provide a communication function.

Recently, as thin, high-transparent and high-resolution display devices such as a transparent display and a flexible display, an antenna having improved transmission/reception sensitivity within a limited thickness may be also needed.

However, as the display device equipped with the antenna becomes thinner and light-weighted, a space for the antenna may be also decreased. Accordingly, an antenna having sensitivity to various broadband signals may not be easily constructed.

Further, when the antennas of different frequency band are arranged in the limited space, radiation reliability may be deteriorated due to a mutual signal interference. When the antenna is disposed at a front-face of the display device, an image quality may be also deteriorated.

SUMMARY

According to an aspect of the present invention, there is provided an antenna device having improved radiation property and spatial efficiency.

According to an aspect of the present invention, there is provided a display device including an antenna device with improved radiation property and spatial efficiency.

(1) An antenna device, including: a dielectric layer; a first radiation pattern disposed on the dielectric layer; a second radiation pattern disposed in the first radiation pattern and partially separated from the first radiation pattern; and a transmission line commonly connected to the first radiation pattern and the second radiation pattern.

(2) The antenna device according to the above (1), further including a first separation region having a discontinuous loop shape, wherein the first radiation pattern and the second radiation pattern are divided by the first separation region.

(3) The antenna device according to the above (2), wherein the first radiation pattern and the second radiation pattern are integrally merged with each other at a discontinuous portion of the first separation region.

(4) The antenna device according to the above (2), further including a first dummy pattern formed around the first radiation pattern, the first dummy pattern having a mesh structure.

(5) The antenna device according to the above (4), further including a second separation region formed along a periphery of the first radiation pattern, wherein the first dummy pattern and the first radiation pattern are separated by the second separation region.

(6) The antenna device according to the above (4), further including a second dummy pattern formed between the first radiation pattern and the second radiation pattern.

(7) The antenna device according to the above (6), further including a third separation region extending along an outer periphery of the first separation region and merged with the first separation region, wherein the second dummy pattern is disposed between the first separation region and the third separation region.

(8) The antenna device according to the above (6), wherein the second dummy pattern has a mesh structure.

(9) The antenna device according to the above (8), wherein the mesh structure of the second dummy pattern includes a plurality of cut regions.

(10) The antenna device according to the above (1), wherein the first radiation pattern and the second radiation pattern have different resonance frequencies.

(11) The antenna device according to the above (10), wherein the first radiation pattern corresponds to a low frequency radiation pattern and the second radiation pattern corresponds to a high frequency radiation pattern.

(12) The antenna device according to the above (1), further comprising a ground layer disposed under the dielectric layer.

(13) The antenna device according to the above (1), further comprising a signal pad connected to an end portion of the transmission line.

(14) The antenna device of the above (13), further comprising an antenna driving integrated circuit chip electrically connected to the signal pad to perform a feeding commonly to the first radiation pattern and the second radiation pattern through the transmission line.

(15) A display device comprising the antenna device according to embodiments as described above.

(16) The display device of the above (15), wherein the first radiation pattern and the second radiation pattern are disposed on a display area of the display device.

In the antenna device according to embodiments of the present invention, radiation patterns of different frequency bands may be substantially integrated into a single pattern. Accordingly, a broadband antenna having sensitivity to a plurality of different types of frequencies may be implemented within a limited space.

The radiation patterns may be connected to a driving circuit unit through one feeding line. Accordingly, the radiation patterns of the different frequency bands may be collectively controlled, and a simultaneous feeding or a switching feeding may be selectively implemented.

In some embodiments, a dummy pattern of a mesh structure may be formed between the radiation patterns, and thus a mutual signal interference between the radiation patterns may be shielded and an electrode visibility may be reduced.

According to exemplary embodiments, the antenna device may be disposed on a front face of a display device to provide the display device having improved transmittance and broadband communication.

DETAILED DESCRIPTION

According to exemplary embodiments of the present invention, there is provided an antenna device in which a plurality of radiation patterns of different frequency bands may be integrated in a single unit antenna pattern.

The antenna device may be, e.g., a microstrip patch antenna fabricated in the form of a transparent film. For example, the antenna device may be applied to a device for high frequency band or ultra-high frequency band (e.g., 3G, 4G, 5G or more) mobile communications.

For example, the antenna device may be operated in a high frequency band of about 1 GHz or more, in an embodiment, in a range from about 20 to about 60 GHz. The antenna device may also be operated in, e.g., a frequency band of 1 GHz or less.

According to exemplary embodiments of the present invention, a display device including the antenna device and capable of implementing a broadband communication is also provided. However, an application of the antenna device is not limited to the display device, and the antenna device may be applied to various objects or structures such as a vehicle, a home electronic appliance, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
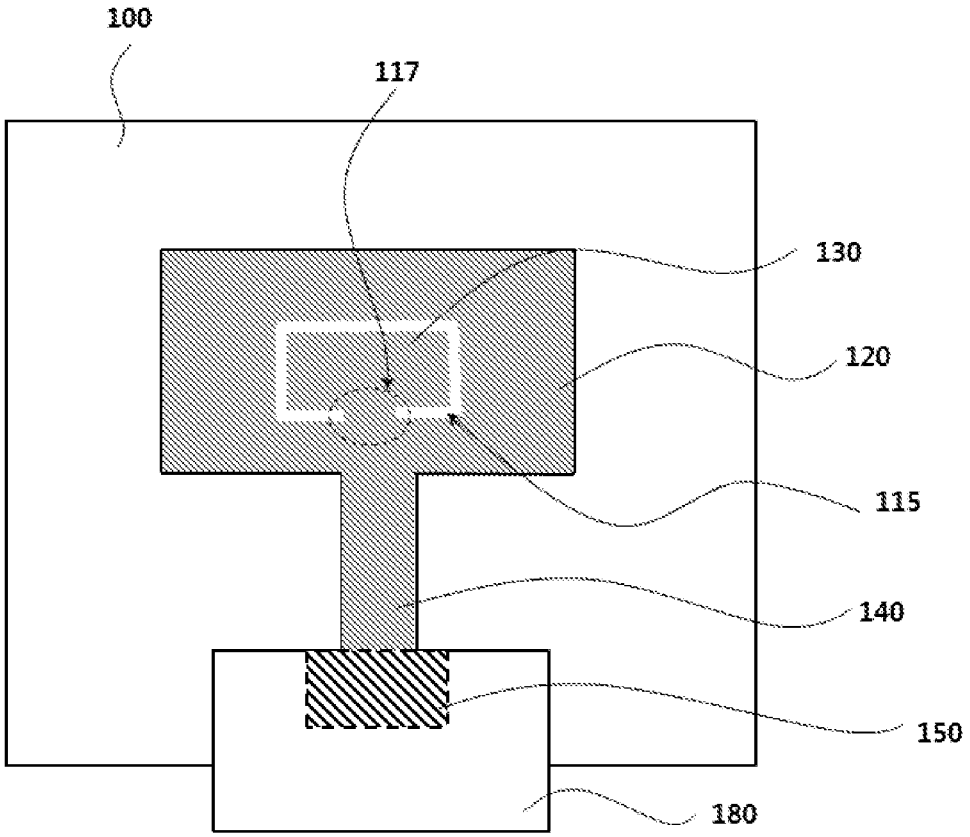
FIGS. 1 and 2 are a schematic top planar view and a schematic cross-sectional view, respectively, illustrating an antenna device in accordance with exemplary embodiments.
Figure 2:
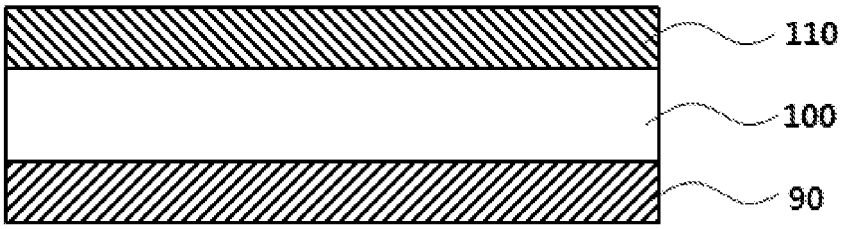

FIGS. 1 and 2 are a schematic top planar view and a schematic cross-sectional view, respectively, illustrating an antenna device in accordance with exemplary embodiments.

Referring to FIG. 1, an antenna device may include a dielectric layer 100 and an antenna electrode layer 110 formed on the dielectric layer 100. The antenna electrode layer 110 may include radiation patterns 120 and 130 and a transmission line 140.

The dielectric layer 100 may include an insulating material having a predetermined dielectric constant. In an embodiment, the dielectric layer 100 may include, e.g., an inorganic insulating material such as glass, silicon oxide, silicon nitride, or metal oxide.

In an embodiment, the dielectric layer 100 may include a transparent resin material. For example, the dielectric layer 100 may include a polyester-based resin such as polyethylene terephthalate, polyethylene isophthalate, polyethylene naphthalate and polybutylene terephthalate; a cellulose-based resin such as diacetyl cellulose and triacetyl cellulose; a polycarbonate-based resin; an acrylic resin such as polymethyl (meth)acrylate and polyethyl (meth)acrylate; a styrene-based resin such as polystyrene and an acrylonitrile-styrene copolymer; a polyolefin-based resin such as polyethylene, polypropylene, a cycloolefin or polyolefin having a norbornene structure and an ethylene-propylene copolymer; a vinyl chloride-based resin; an amide-based resin such as nylon and an aromatic polyamide; an imide-based resin; a polyethersulfone-based resin; a sulfone-based resin; a polyether ether ketone-based resin; a polyphenylene sulfide resin; a vinyl alcohol-based resin; a vinylidene chloride-based resin; a vinyl butyral-based resin; an allylate-based resin; a polyoxymethylene-based resin; an epoxy-based resin; a urethane or acryl urethane-based resin; a silicone-based resin, etc. These may be used alone or in a combination of two or more thereof.

In some embodiments, an adhesive film such as an optically clear adhesive (OCA), an optically clear resin (OCR), or the like may be included in the dielectric layer 100.

A capacitance or an inductance may be formed by the dielectric layer 100 so that a frequency band at which the antenna device may be driven or operated may be adjusted. In some embodiments, a dielectric constant of the dielectric layer 100 may be adjusted in a range from about 1.5 to about 12, preferably from about 2 to about 12. When the dielectric constant exceeds about 12, a driving frequency may be excessively reduced so that an antenna driving in a desired high frequency band may not be realized.

In some embodiments, an insulating layer (e.g., an encapsulation layer, a passivation layer, etc., of a display panel) at an inside of the display device to which the antenna element is applied may serve as the dielectric layer 100.

The antenna electrode layer 110 may include a plurality of radiation patterns of different resonance frequency bands. For example, the antenna electrode layer 110 may include a first radiation pattern 120 and a second radiation pattern 130, and the second radiation pattern 130 may be included in the first radiation pattern 120.

In FIG. 1, a shape of each radiation pattern 120 and 130 is illustrated as a square. However, the shape of the radiation patterns 120 and 130 may be appropriately changed in consideration of an area and frequencies of the antenna device.

In exemplary embodiments, the first radiation pattern 120 and the second radiation pattern 130 may be connected to each other to be substantially provided as a single pattern.

For example, a first separation region 115 may be formed in the first radiation pattern 120 to define a boundary or an edge of the second radiation pattern 130. The first separation region 115 may have a partially opened or discontinuous ring or loop shape.

A merged region 117 may be defined by a cut or discontinuous portion of the first separation region 115, and the first radiation pattern 120 and the second radiation pattern 130 may be merged via the merged region 117 to serve as a substantially single conductive pattern.

As illustrated in FIG. 1, the merge region 117 may be formed to be adjacent to the transmission line 140. For example, the merged region 117 may be connected to a lower side of the second radiation pattern 130 and may be positioned on a straight line from the transmission line 140.

However, the position of the merged region 117 may be properly changed, and may not be particularly limited to a specific region. For example, the merged region 117 may be connected to a lateral side or an upper side of the second radiation pattern 130, and two or more merged regions 117 may be formed.

The first radiation pattern 120 and the second radiation pattern 130 may be radiated or driven in different frequency bands. In some embodiments, the second radiation pattern 130 formed at an inside or at an interior of the first radiation pattern 120 may have a resonance frequency corresponding to a relatively high frequency, and the first radiation pattern 120 may haves a resonance frequency corresponding to a relatively low frequency.

For example, the second radiation pattern 130 may have a resonance frequency corresponding to 5G communication (e.g., about 28 to 30 GHz), and the first radiation pattern 120 may have a resonance frequency corresponding to Wi-Fi (e.g., a resonance frequency corresponding to about 2.5 to 5 GHz) or 4G communication (e.g., about 1.7 to 2 GHz).

The transmission line 140 may be connected to an end portion of the first radiation pattern 120. In an embodiment, the transmission line 140 may be formed as an integral member extending from the first radiation pattern 120.

As described above, the first radiation pattern 120 and the second radiation pattern 130 have a single conductive pattern shape connected to each other, so that the transmission line 140 may serve as a common feeding line for the first radiation pattern 120 and the second radiation pattern 130.

A signal pad 150 may be connected to an end portion of the transmission line 140. The signal pad 150 may be directly connected to the transmission line 140 at the same layer or level. In an embodiment, the signal pad 150 may be electrically connected to the signal pad 150 through a contact or a via at an upper level of the transmission line 140.

An antenna driving integrated circuit (IC) chip 180 may be electrically connected to the transmission line 140 through the signal pad 150. Accordingly, a feeding and a radiation driving of the radiation patterns 120 and 130 may be controlled by the antenna driving IC chip 180.

As described above, a plurality of the radiation patterns corresponding to different resonance frequencies may be substantially integrated into a single pattern unit, so that a communication of a plurality of frequency bands may be performed through the single transmission line 140 and the antenna driving IC chip 180.

For example, a feeding signal corresponding to the first radiation pattern 120 or the second radiation pattern 130 may be selectively transmitted through the antenna driving IC chip 180, so that a switching of the first radiation pattern 120 or the second radiation pattern 130 may be implemented. Additionally, a simultaneous radiation of the first radiation pattern 120 or the second radiation pattern 130 may be also performed through the antenna driving IC chip 180.

For example, each area of the first radiation pattern 120 and the second radiation pattern 130 may be adjusted, so that a frequency band operated by each radiation pattern may be controlled. Additionally, a separation distance between the first radiation pattern 120 and the second radiation pattern 130 may be adjusted by a width of the first separation region 115. An impedance matching of the first radiation pattern 120 and the second radiation pattern 130 may be implemented by the separation distance.

The antenna electrode layer 110 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy containing at least one of the metals.

For example, the antenna electrode layer 110 may include silver (Ag) or a silver alloy (e.g., a silver-palladium-copper (APC) alloy), or copper or a copper alloy (e.g., a copper-calcium (CuCa) alloy) for implementing a low resistance and a fine line width.

In some embodiments, the antenna electrode layer 110 may include a transparent metal oxide such as indium tin oxide (ITO), indium zinc oxide (IZO), indium zinc tin oxide (ITZO), zinc oxide (ZnOx), cadmium tin oxide (CTO), etc.

In some embodiments, the antenna electrode layer 110 may include a stacked structure of a transparent conductive oxide and a metal, and may have, e.g., a triple-layered structure of a transparent conductive oxide layer-metal layer-transparent conductive oxide layer. In this case, a resistance may be reduced by the metal layer so that a signaling speed may be increased while improving a flexible property. Further, a corrosion resistance and transparency may be improved by the transparent conductive oxide layer.

In some embodiments, a ground layer 90 may be formed on a bottom surface of the dielectric layer 100. For example, capacitance or inductance may be generated between the antenna electrode layer 110 and the ground layer 90 by the dielectric layer 100, so that a frequency band at which the antenna device may be operated may be adjusted. For example, the antenna device may serve as a vertical radiation antenna.

The ground layer 90 may include the above-described metal, the alloy or the transparent conductive oxide. In an embodiment, a conductive member of the display device to which the antenna device is applied may serve as the ground layer 90.

The conductive member may include various wires or electrodes included in a display panel, or various metallic structures disposed under the display panel such as an SUS plate, a heat dissipation sheet, a digitizer, etc.

In a non-limiting example, a length of the transmission line 140 may be from about 0.5 mm to about 7 mm to obtain a 5G resonance frequency, and a thickness of the dielectric layer 100 may be from about 40 μm to about 1,000 μm.

FIG. 1 illustrates an example in which the first and second radiation patterns 120 and 130 are included in one antenna structure, but three or more radiation patterns may be integrated.

Figure 3:
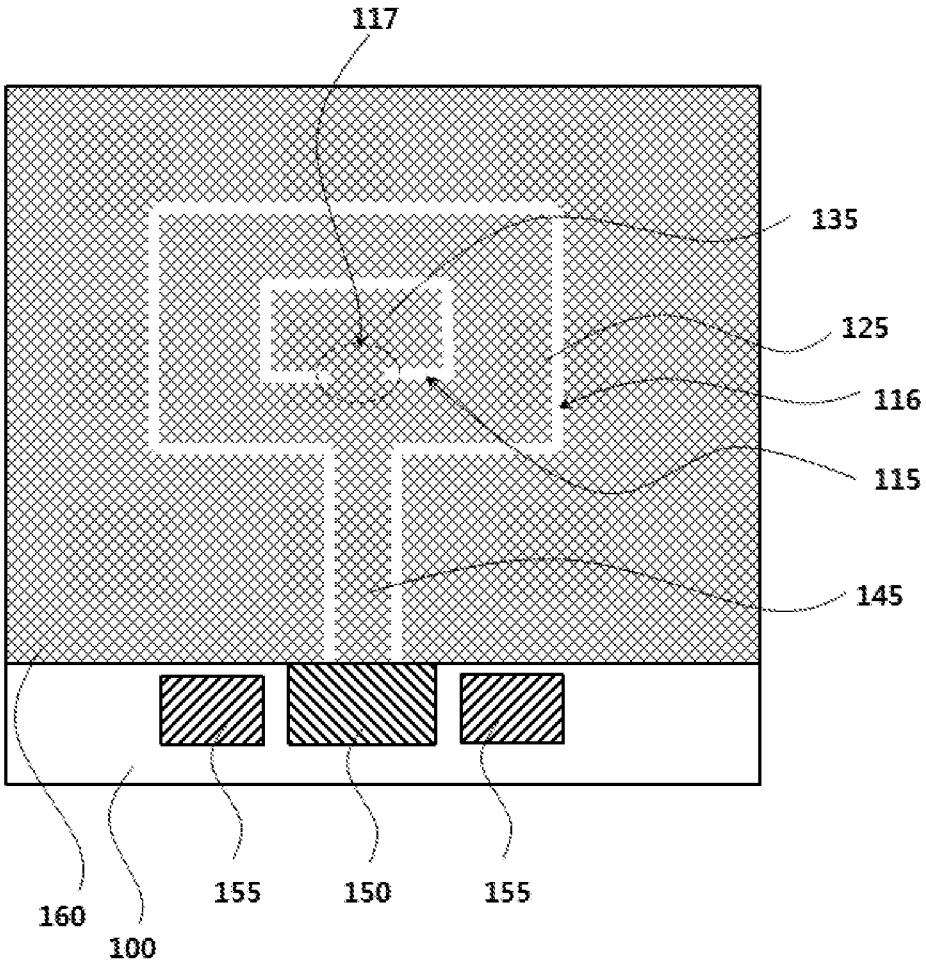
FIG. 3 is a schematic top planar view illustrating an antenna device in accordance with some exemplary embodiments.

FIG. 3 is a schematic top planar view illustrating an antenna device in accordance with some exemplary embodiments. Detailed descriptions on elements and/or structures substantially the same as or similar to those described with reference to FIGS. 1 and 2 are omitted herein.

Referring to FIG. 3, the antenna electrode layer 110 may include a mesh structure in which a plurality of electrode lines may cross each other. Accordingly, radiation patterns 125 and 135 and a transmission line 145 may include the mesh structure.

For example, a conductive layer may be formed on the dielectric layer 100, and then the conductive layer may be etched to form a mesh structure. The radiation patterns 125 and 135, and the transmission line 145 may be defined by forming a separation regions together with the formation of the mesh structure.

In an embodiment, a boundary between the first radiation pattern 125 and the transmission line 145 may be formed by a second separation region 116. Additionally, the first separation region 115 may be formed at an inside of the second separation region 116 to define the second radiation pattern 135.

As described above, the first separation region 115 may have an opened or cut ring shape, and the first and second radiation patterns 125 and 135 may be merged with each other by the merged region 117 at which the first separation region 115 is opened.

A first dummy pattern 160 may be defined by a portion of a mesh conductive layer at an outside of the second separation region 116. The first dummy pattern 160 may surround the first radiation pattern 125 and the transmission line 145.

In some embodiments, the signal pad 150 may have a solid pattern structure to reduce a feeding resistance. For example, the signal pad 150 may be formed as a solid pattern including the above-described metal or alloy.

In an embodiment, a ground pad 155 may be disposed around the signal pad 150. For example, a pair of the ground pads 155 may face each other with the signal pad 150 interposed therebetween, and may be spaced apart from the signal pad 150 and the transmission line 145.

As described above, the radiation patterns 125 and 135 may include the mesh structure so that transmittance of the antenna device may be improved. Additionally, the first dummy pattern 160 including the mesh structure may be distributed around the radiation patterns 125 and 135 so that structures and shapes of the electrode patterns may become uniform. Thus, an increase in electrode visibility due to a variation in the electrode shape may be prevented.

Figure 4:
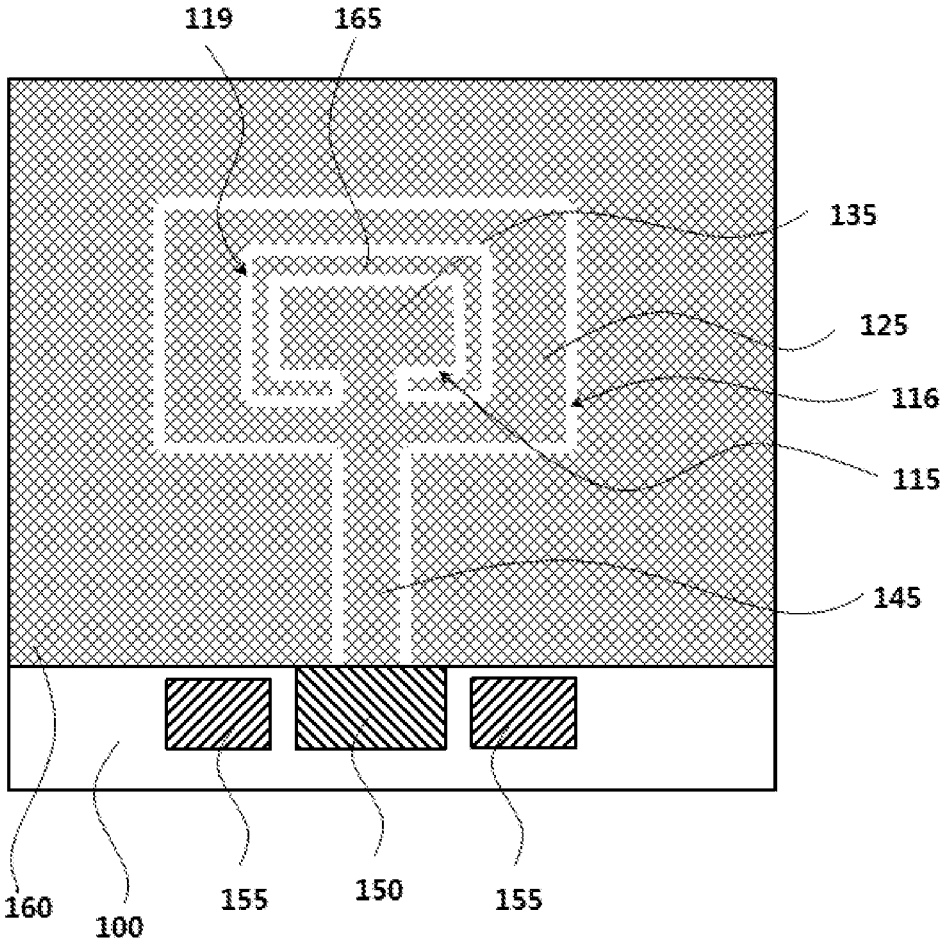
FIG. 4 is a schematic top planar view illustrating an antenna device in accordance with some exemplary embodiments.

FIG. 4 is a schematic top planar view illustrating an antenna device in accordance with some exemplary embodiments. Detailed descriptions on elements and/or structures substantially the same as or similar to those described with reference to FIG. 3 are omitted.

Referring to FIG. 4, a second dummy pattern 165 may be disposed between the first radiation pattern 125 and the second radiation pattern 135.

For example, a third separation region 119 may be added between the first radiation pattern 125 and the second radiation pattern 135. The third separation region 119 may extend along a periphery of the first separation region 115 and may be merged with the first separation area 115.

A dummy region may be defined by the merged first and third separation regions 115 and 119, and the second dummy pattern 165 electrically and physically separated from the first radiation pattern 125 and the second radiation pattern 135 may be formed in the dummy region.

In some embodiments, the second dummy pattern 165 may include a mesh structure having substantially the same shape as those in the radiation patterns 125 and 135 and the first dummy pattern 160. Accordingly, uniformity of electrode patterns may be further improved, thereby effectively preventing the electrode visibility.

Further, the second dummy pattern 165 may serve as a barrier for absorbing or blocking noise and signal interference between the first radiation pattern 125 and the second radiation pattern 135. Accordingly, a radiation independence of the first radiation pattern 125 and the second radiation pattern 135 connected integrally with each other may be more effectively achieved by the second dummy pattern 165.

Figure 5:
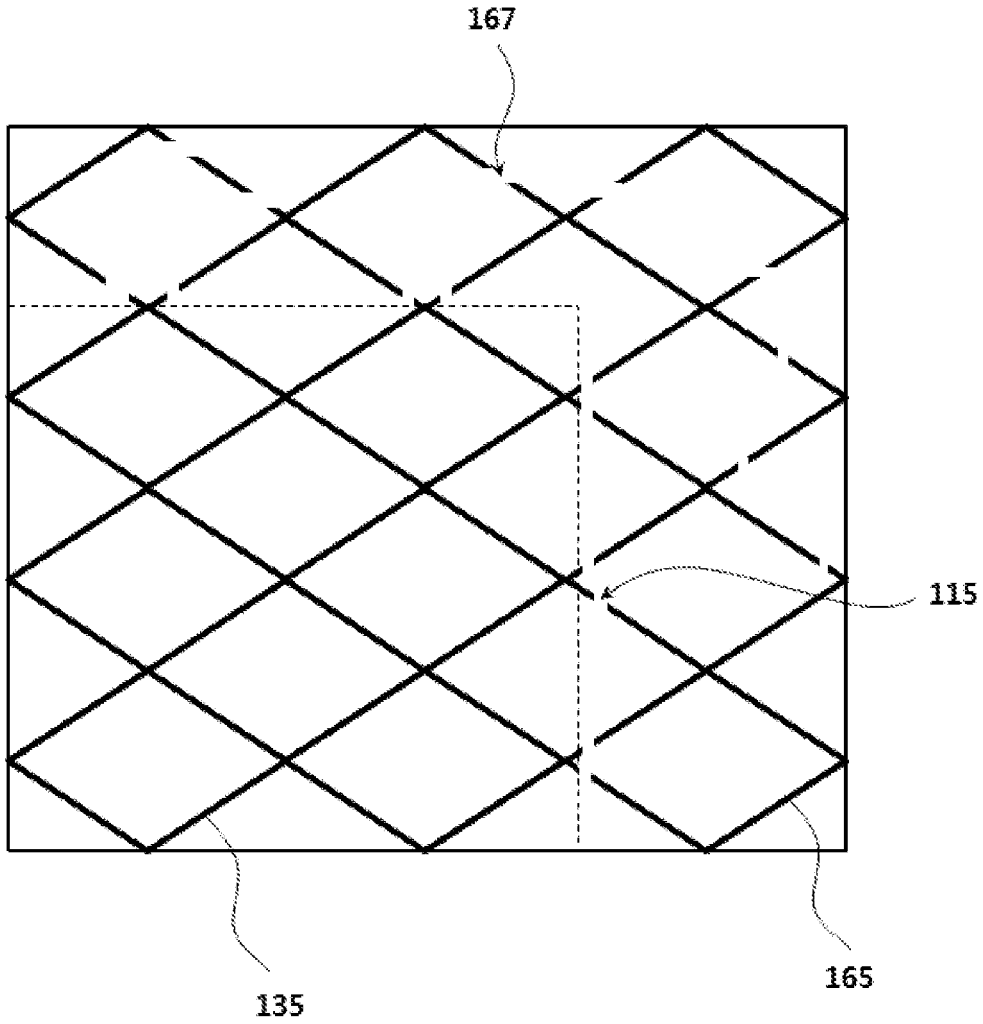
FIG. 5 is a partially enlarged top planar view illustrating a dummy pattern of an antenna device in accordance with exemplary embodiments.

FIG. 5 is a partially enlarged top planar view illustrating a dummy pattern of an antenna device in accordance with exemplary embodiments. For example, FIG. 5 is an enlarged view illustrating a mesh structure of the second radiation pattern 135 and the second dummy pattern 165 around the first separation region 115.

Referring to FIG. 5, the first separation region 115 may have shape of a cut mesh structure as described above, and a boundary or a periphery of the second radiation pattern 135 may be formed as indicated by a dotted line.

Cut regions 167 formed by cutting electrode lines included in the mesh structure may be distributed in the second dummy pattern 165. For example, the cut regions 167 may be irregularly distributed in the second dummy pattern 165, so that electrode visibility or moiré phenomenon due to a regular repetition of a pattern shape may be reduced or alleviated.

Further, the cut regions 167 may be formed in the second dummy pattern 165, so that radiation interference and noise between the second radiation pattern 135 and the first radiation pattern 125 may be more effectively blocked or shielded.

Figure 6:
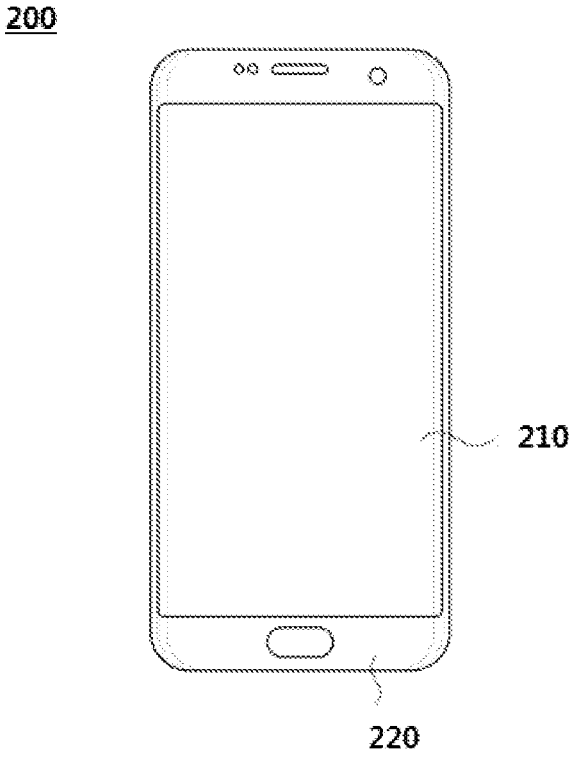
FIG. 6 is a schematic top planar view illustrating a display device in accordance with exemplary embodiments.

FIG. 6 is a schematic top planar view illustrating a display device in accordance with exemplary embodiments. For example, FIG. 6 illustrates an outer shape including a window of a display device.

Referring to FIG. 6, a display device 200 may include a display area 210 and a peripheral area 220. The peripheral area 220 may be disposed on, e.g., both lateral portions and/or both end portions of the display area 210.

In some embodiments, the above-described antenna device may be disposed at a front face of the display device 200. In this case, the radiation patterns 120, 125, 130 and 135 and the dummy patterns 160 and 165 of the antenna device may be disposed at the display area 210. As described above, the mesh structure may be used to improve transmittance and suppress electrode visibility.

The antenna driving IC chip 180 may be disposed to correspond to the peripheral area 220 of the display apparatus 200. The peripheral area 220 may correspond to, e.g., a light-shielding portion or a bezel portion of the display device. The signal pad 150 may be disposed at the peripheral area 220. Accordingly, the antenna driving IC chip 180 and the signal pad 150 may be electrically connected to each other in the peripheral area 220 to perform a feeding through the transmission line 140 and 145.

According to exemplary embodiments, the radiation patterns 120, 125, 130 and 135 of different resonance frequencies may be integrated to encompass a high-frequency band and a low-frequency band, and a communication function with improved spatial efficiency may be implemented in the display device 200.

What is claimed is:

1. An antenna device, comprising:

a dielectric layer;

a first radiation pattern disposed on the dielectric layer;

a second radiation pattern disposed in the first radiation pattern and partially separated from the first radiation pattern;

a transmission line commonly connected to the first radiation pattern and the second radiation pattern;

a first separation region having a discontinuous loop shape and dividing the first radiation pattern and the second radiation pattern; and a first dummy pattern formed around the first radiation pattern and having a mesh structure.

2. The antenna device according to claim 1, wherein the first radiation pattern and the second radiation pattern are integrally merged with each other at a discontinuous portion of the first separation region.

3. The antenna device according to claim 1, further comprising a second separation region formed along a periphery of the first radiation pattern, wherein the first dummy pattern and the first radiation pattern are separated by the second separation region.

4. The antenna device according to claim 1, further comprising a second dummy pattern formed between the first radiation pattern and the second radiation pattern.

5. The antenna device according to claim 4, further comprising a third separation region extending along an outer periphery of the first separation region and merged with the first separation region, wherein the second dummy pattern is disposed between the first separation region and the third separation region.

6. The antenna device according to claim 4, wherein the second dummy pattern has a mesh structure.

7. The antenna device according to claim 6, wherein the mesh structure of the second dummy pattern includes a plurality of cut regions.

8. The antenna device according to claim 1, wherein the first radiation pattern and the second radiation pattern have different resonance frequencies.

9. The antenna device according to claim 8, wherein the first radiation pattern corresponds to a low frequency radiation pattern and the second radiation pattern corresponds to a high frequency radiation pattern.

10. The antenna device according to claim 1, further comprising a ground layer disposed under the dielectric layer.

11. The antenna device according to claim 1, further comprising a signal pad connected to an end portion of the transmission line.

12. The antenna device of claim 11, further comprising an antenna driving integrated circuit chip electrically connected to the signal pad to perform a feeding commonly to the first radiation pattern and the second radiation pattern through the transmission line.

13. A display device comprising an antenna device, the antenna device comprising:

a dielectric layer;

a first radiation pattern disposed on the dielectric layer;

a second radiation pattern disposed in the first radiation pattern and partially separated from the first radiation pattern; and a transmission line commonly connected to the first radiation pattern and the second radiation pattern.

14. The display device of claim 13, wherein the first radiation pattern and the second radiation pattern are disposed on a display area of the display device.

* * * * *